US010340111B2

(12) United States Patent
Kawai et al.

(10) Patent No.: US 10,340,111 B2
(45) Date of Patent: Jul. 2, 2019

(54) FUSE

(71) Applicant: TOYODA IRON WORKS CO., LTD., Toyota-shi, Aichi-ken (JP)

(72) Inventors: Shunsuke Kawai, Toyota (JP); Hideaki Sakai, Toyota (JP); Yasuhiro Sone, Toyota (JP); Kunihiro Iwata, Toyota (JP)

(73) Assignee: TOYODA IRON WORKS CO., LTD. (JP)

( * ) Notice: Subject to any disclaimer, the term of this patent is extended or adjusted under 35 U.S.C. 154(b) by 0 days.

(21) Appl. No.: 15/579,784

(22) PCT Filed: Jun. 2, 2016

(86) PCT No.: PCT/JP2016/066323
§ 371 (c)(1),
(2) Date: Dec. 5, 2017

(87) PCT Pub. No.: WO2016/199656
PCT Pub. Date: Dec. 15, 2016

(65) Prior Publication Data

US 2018/0174791 A1 Jun. 21, 2018

(30) Foreign Application Priority Data

Jun. 8, 2015 (JP) ..... 2015-116003

(51) Int. Cl.
*H01H 85/20* (2006.01)
*H01H 85/055* (2006.01)
(Continued)

(52) U.S. Cl.
CPC ..... *H01H 85/20* (2013.01); *H01H 85/055* (2013.01); *H01H 85/175* (2013.01);
(Continued)

(58) Field of Classification Search
CPC .... H01H 85/20; H01H 85/055; H01H 85/175; H01H 2033/888; H01H 2085/381;
(Continued)

(56) References Cited

U.S. PATENT DOCUMENTS 2,395,206 A 2/1946 Wiard
4,032,879 A * 6/1977 Monagan ..... H01H 85/42 337/162
(Continued)

FOREIGN PATENT DOCUMENTS

DE 2322582 A1 11/1973
JP H1012111 A 1/1998
(Continued)

OTHER PUBLICATIONS

Tanahashi Yasuhiro, "Cartridge Fuse and its Assembling Method", Apr. 22, 2004, Energy Support Corp, Entire Document (Translation of JP 2004127902—original provided, cited in IDS). (Year: 2004).*
(Continued)

*Primary Examiner* — Anatoly Vortman
*Assistant Examiner* — Stephen S Sul
(74) *Attorney, Agent, or Firm* — Tarolli, Sundheim, Covell & Tummino LLP

(57) ABSTRACT

Provided herein is a fuse that includes a conductive member, two shielding portions arranged on the conductive member, and a case. The conductive member includes a two bars on each end of the conductive member and an element (e.g., melting portion) that integrally connects the two bars. The two shielding members are disk shaped and are situated on the conductive member between the element and the two bars. The case encloses the element and the two shielding members.

3 Claims, 5 Drawing Sheets

(51) Int. Cl.
*H01H 85/175* (2006.01)
*H01H 85/18* (2006.01)
*H01H 85/10* (2006.01)

(52) U.S. Cl.
CPC ..... *H01H 85/185* (2013.01); *H01H 85/10* (2013.01); *H01H 85/18* (2013.01)

(58) Field of Classification Search
CPC ..... H01H 2085/383; H01H 9/22; H01H 85/0026; H01H 85/0056; H01H 85/006; H01H 85/0065; H01H 85/202; H01H 85/203
USPC ..... 361/186, 231, 273
See application file for complete search history.

(56) References Cited

U.S. PATENT DOCUMENTS 4,646,053 A * 2/1987 Mosesian ..... H01H 85/157 337/232
4,851,805 A * 7/1989 Poerschke ..... H01H 69/02 337/231
5,345,210 A * 9/1994 Swensen ..... H01H 85/055 337/163
5,426,411 A * 6/1995 Pimpis ..... H01H 85/153 29/623
5,596,306 A * 1/1997 Kowalik ..... H01H 85/055 337/165
5,994,994 A * 11/1999 Ito ..... H01H 85/0418 337/228
9,558,905 B2 * 1/2017 Arce ..... H01H 85/165
9,761,402 B2 * 9/2017 Schlaak ..... H01H 85/185
2004/0021546 A1 * 2/2004 Nakano ..... H01H 85/157 337/186
2009/0108980 A1 * 4/2009 Whitney ..... H01H 37/761 337/161
2015/0348731 A1 * 12/2015 Douglass ..... H01H 69/02 337/198
2016/0141138 A1 * 5/2016 Schlaak ..... H01H 85/185 337/231

FOREIGN PATENT DOCUMENTS

JP 2004127902 A 4/2004
JP 2005235705 A 9/2005
JP 2012043573 A 3/2012

OTHER PUBLICATIONS

International Preliminary Report on Patentability for corresponding International Application No. PCT/JP2016/066323, dated Dec. 12, 2017.
International Search Report for corresponding international application No. PCT/JP2016/066323, dated Aug. 16, 2016.

* cited by examiner

FUSE

RELATED APPLICATIONS

The present invention is a U.S. National Stage under 35 USC 371 patent application, claiming priority to Serial No. PCT/JP2016/066323, filed on 2 Jun. 2016; which claims priority of JP 2015-116003, filed on 8 Jun. 2015, the entirety of both of which are incorporated herein by reference.

TECHNICAL FIELD

The present invention relates to a fuse.

BACKGROUND ART

A known fuse is arranged between a power supply and an electric circuit to limit situations in which overcurrent adversely affects the function of the electric circuit or an electric device.

Patent document 1 describes a fuse that includes two conductors each including a flanged bulging head, a fusible alloy piece located between and connected through welding to the two bulging heads that oppose each other in a direction in which the conductors extend, and a tubular insulator that accommodates the two bulging heads and the fusible alloy piece.

In this fuse, the fusible alloy piece has a lower melting point than the conductors. Thus, when overcurrent occurs in the fuse, the fusible alloy piece melts and breaks but the conductors do not. The melting and breakage may generate an arc. However, the portion where the arc is generated is located between the two bulging heads. The two bulging portions serve as barriers that limit the range in which the fusible alloy piece scatters.

PRIOR ART DOCUMENT

Patent Document

Patent Document 1: Japanese Laid-Open Patent Publication No. 10-12111

SUMMARY OF THE INVENTION

Problems that are to be Solved by the Invention

In the fuse of patent document 1, the fusible alloy piece needs to be welded between the two conductors. Thus, the quality of welding may change the amount of current that melts and breaks the fusible alloy piece.

It is an object of the present invention to provide a fuse that reduces differences in performance between products and can be manufactured more easily.

Means for Solving the Problem

To solve the above problem, a fuse includes a conductive member formed integrally with a melting portion that melts and breaks when overcurrent occurs, two shielding portions arranged on the conductive member to hold the melting portion in between, and a case formed from an electrically-insulative material. The case encloses the melting portion in cooperation with the two shielding portions.

In this structure, the melting portion is part of the conductive member. Thus, the fuse does not need to be welded during manufacturing like in the prior art. Accordingly, the fuse 1 can be manufactured more easily. Further, the holding task is easier than welding. This reduces the difference in performance between manufactured bus bars. Consequently, the fuse that produces stable performance can be manufactured. In addition, the melting portion is surrounded by the two shielding portions and the case. Thus, when the melting portion melts, the collection of the molten conductive member on other products is limited.

In the above structure, it is preferred that each shielding portion be a shielding member that is separate from the conductive member and that one of the shielding member and the conductive member include a holder that holds the other one of the shielding member and the conductive member.

This structure facilitates the adjustment of the distance between the melting portion and the shielding member and consequently facilitates the adjustment of the scattering range of the melting portion when the melting portion melts and breaks. This structure also facilitates the adjustment of the target amount of current that melts and breaks the melting portion. Since the conductive member is separate from the shielding member, manufacturing is facilitated even when the conductive member is integrated with the shielding member into a complicated shape.

In the above structure, it is preferred that the shielding member include the holder and a slot through which the holder is in communication with an outer side of the holder and that the shielding member be coupled to the conductive member by the holder by performing swaging to close portions spaced apart by the slot in a state in which the conductive member is inserted into the holder through the slot.

In this structure, the simple structure of the slot is arranged, and the task for swaging to close the portions spaced apart by the slot is performed. This coupled the shielding member to the conductive member.

In the above structure, it is preferred that the shielding member includes a first member and a second member, and the first member and the second member hold the conductive member in between. Further, it is preferred that the case include a first case and a second case. The first case covers an outer surface of the first member and is integrated with the first member, and the second case covers an outer surface of the second member and is integrated with the second member. In addition, it is preferred that the fuse include a fastener that is arranged in at least one of between the first member and the second member and between the first case and the second case. The fastener acts to have the first member and the second member function as the holder by restricting movement spacing apart the first member and the second member and keeping the first member and the second member coupled to each other.

In this structure, a simple task for holding the conductive member between the first member and the second member allows the shielding member to be coupled to the conductive member. Further, the melting portion and the shielding portion are surrounded by the case. This reduces the number of assembling steps.

In the above structure, it is preferred that the conductive member include the holder and that the holder include two opposing parts that oppose each other over a distance that is less than a thickness of the shielding member in a holding direction and elastically hold the shielding member in between.

In this structure, insertion of the shielding member into the holder pushes the two opposing parts away from each other against a resilient force. The shielding member is held by the resilient force acting to return the two opposing parts back toward each other. Such a simple task allows the shielding member to be coupled to the conductive member.

Effect of the Invention

The fuse of the present invention has the advantage that the fuse reduces differences in performance between products and can be manufactured more easily.

EMBODIMENTS OF THE INVENTION

First Embodiment

A first embodiment of a fuse will now be described. The fuse is arranged, for example, between a battery and an inverter of a hybrid vehicle.

Structure

Figure 1:
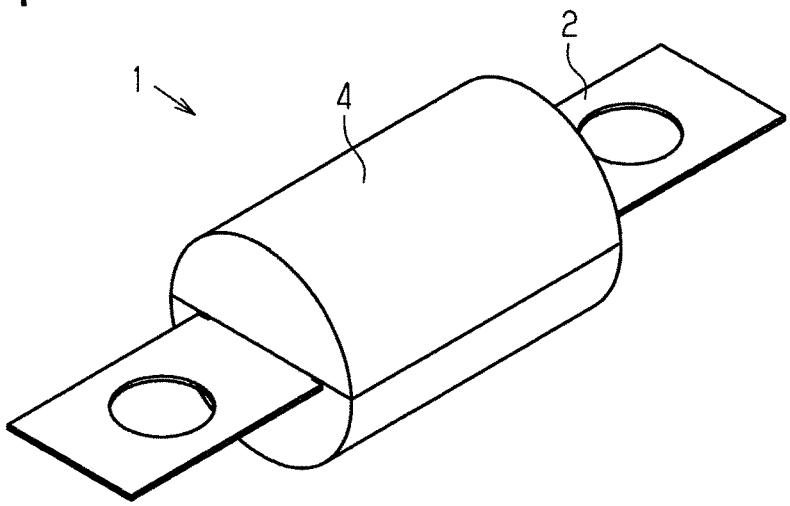
FIG. 1 is a perspective view showing a first embodiment of a fuse.
Figure 2:
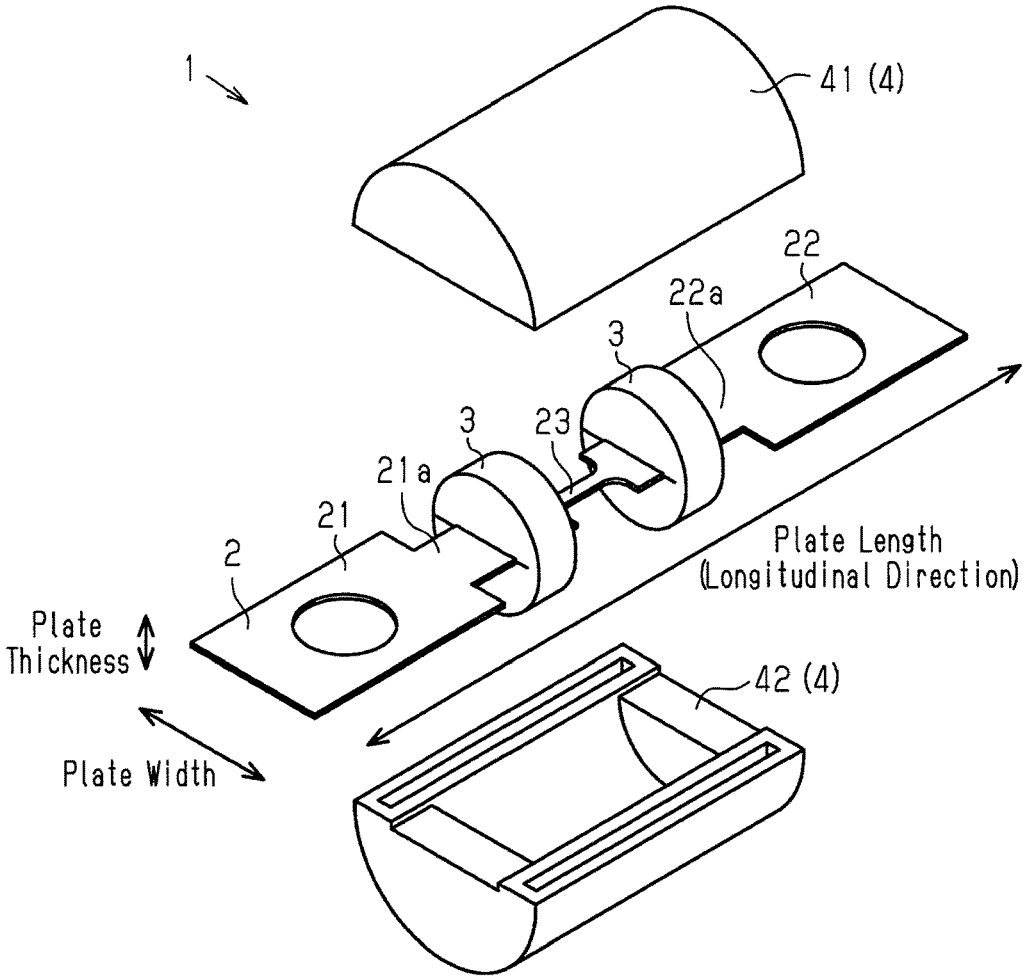
FIG. 2 is an exploded perspective view showing the fuse of the first embodiment.

As shown in FIGS. 1 and 2, the fuse 1 includes a bus bar 2, two blocks 3, and a case 4.

As shown in FIG. 2, the bus bar 2 is elongated as a whole and formed from a conductive metal such as copper. The bus bar 2 includes a first bar 21 and a second bar 22 that extend in a longitudinal direction and an element 23 that connects the first bar 21 and the second bar 22 in the longitudinal direction. The first and second bars 21 and 22 are formed integrally with the element 23. The first and second bars 21 and 22 are equal in plate width, plate thickness, and length (plate length) in the longitudinal direction. The width of the element 23 is less than the plate widths of the first and second bars 21 and 22, more specifically, the plate widths of block coupling portions 21*a* and 22*a* that are portions of the first and second bars 21 and 22 located toward the element 23. The plate widths of the block coupling portions 21*a* and 22*a* are less than the plate widths of other portions of the first and second bars 21 and 22. The plate width and plate thickness of the element 23 are defined by factors such as the target amount of current that melts and breaks the element 23, the distance between the two blocks 3 (described later), and the entire length of the bus bar 2 (described later). Further, the bus bar 2 corresponds to a conductive member, and the element 23 corresponds to a melting portion.

As shown in FIG. 2, each block 3 is cylindrical and formed from a conductive metal such as copper. The block 3 has a diameter (outer diameter) that is greater than the plate widths of the first and second bars 21 and 22. As shown in FIG. 3D, the block 3 includes a through hole 31 extending through the block 3 in an axial direction. The through hole 31 is rectangular and includes vertical surfaces 32 and horizontal surfaces 33 as viewed in the axial direction of the block 3. Each vertical surface 32 corresponds to a plate thickness direction of the first and second bars 21 and 22, and each horizontal surface 33 corresponds to a plate width direction of the first and second bars 21 and 22. The vertical surface 32 is slightly greater in dimension than the plate thickness of the first and second bars 21 and 22 (block coupling portions 21*a* and 22*a*), and the horizontal surface 33 is slightly greater in dimension than the first and second bars 21 and 22 (block coupling portions 21*a* and 22*a*). The block 3 corresponds to a shielding portion and a shielding member.

The shape of the block 3 when manufactured is as follows. As shown in FIG. 3C, the block 3 includes a slot 34 and a slit 35. The slot 34 extends from one of the vertical surfaces 32 (right side in FIG. 3C) and away from the other one of the vertical surfaces 32 (left side in FIG. 3C) to an outer circumference of the block 3. The slit 35 extends from the right vertical surface 32 and away from the left vertical surface 32 and does not reach the outer circumference of the block 3. The block 3 opens about a distal end of the slit 35 when the portions spaced apart by the slot 34 are separated from each other. That is, before the block 3 is coupled to the bus bar 2, the block 3 is C-shaped as viewed in the axial direction.

Figure 3A:
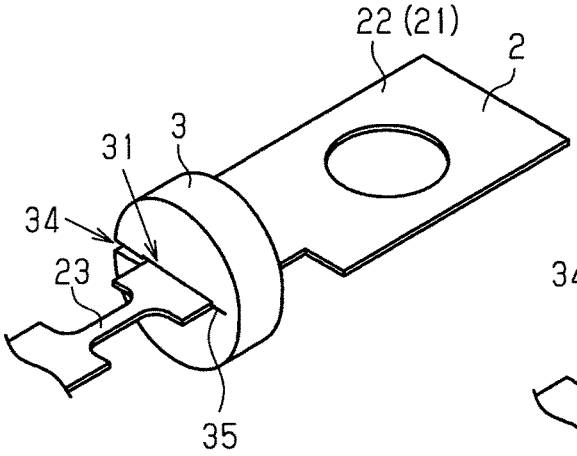
FIG. 3A is a perspective view showing part of the fuse before a block is fixed to a bus bar in the first embodiment.
Figure 3B:
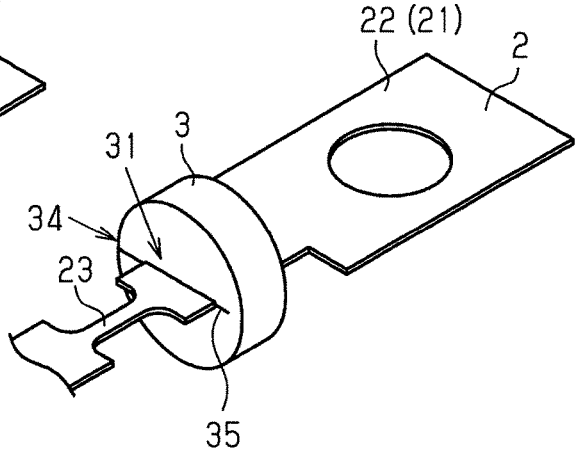
FIG. 3B is a perspective view showing part of the fuse after the block is fixed to the bus bar.
Figure 3C:
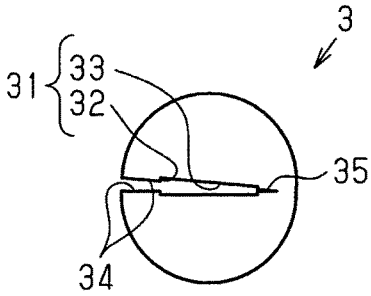
FIG. 3C is a front view showing the block before the block is fixed to the bus bar.
Figure 3D:
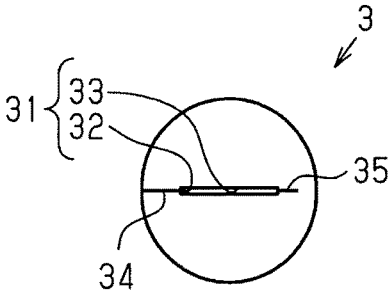
FIG. 3D is a front view showing the block after the block is fixed to the bus bar.

As shown in FIG. 3A, the block 3 is swaged so that the portions spaced apart by the slot 34 and the slit 35 move toward each other in a state in which the bus bar 2 is inserted from the opening slot 34 and set in the through hole 31. As shown in FIG. 3B, the block 3 is plastically deformed from the C-shaped form to the cylindrical form and fixed to the bus bar 2. Thus, the blocks 3 are maintained in a state in which the blocks 3 are holding the bus bar 2 in between in the thickness-wise direction. The portions spaced apart by the slot 34 and the slit 35 are closed. Further, the bus bar 2 is maintained in a state in which contact pressure acts between the vertical surfaces 32 and the horizontal surfaces 33, which form the through hole 31. That is, the through hole 31 corresponds to a holder.

The present example includes the slot 34 and the slit 35. The separated distance of the portions spaced apart by the slot 34 only needs to be set so as to allow the insertion of the bus bar 2. Further, the slit 35 may have any slit length. Alternatively, the slit 35 may be omitted.

As shown in FIG. 2, the case 4 includes two semi-tubular cases 41 and 42 formed from an electrically-insulative resin material. The semi-tubular cases 41 and 42 are coupled to each other and become tubular as a whole. The semi-tubular cases 41 and 42 are fastened by a fastener such as a snap-fit (not shown). The case 4 accommodates the two blocks 3 and the element 23, which is held between the two blocks 3. The inner diameters of the semi-tubular cases 41 and 42 are slightly larger than the outer diameter of the block 3. Further, it is desired that the gap in the case 4, for example, the open space surrounded by the two blocks 3 and the case 4, be filled with an arc extinguishing material such as silica.

Operation

The method for assembling the fuse 1 will now be described.

As shown in FIG. 3A, when assembling the fuse 1, the C-shaped block 3 is first set on the block coupling portion 21*a* of the first bar 21 and the block coupling portion 22*a* of the second bar 22. Subsequently, as shown in FIG. 3B, the block 3 is swaged so that the two portions spaced apart by the slot 34 move toward each other. This fixes the two blocks 3 to the block coupling portions 21*a* and 22*a* of the bus bar 2.

Then, as shown in FIG. 2, the two semi-tubular cases 41 and 42 are moved toward and fixed to each other to hold the element 23 and the two blocks 3 in between in the thickness-wise direction of the bus bar 2. Thus, the element 23 and the two blocks 3 are accommodated in the case 4. In this manner, the assembling of the fuse 1 is completed without the need for a process such as welding between the element 23 and the two blocks 3 (bus bar 2).

The case 4 may be filled with the arc extinguishing material when coupling the semi-tubular cases 41 and 42. Further, the case 4 (either semi-tubular cases 41 or 42) may include a hole (not shown) so that the case 4 is filled with the arc extinguishing material through the hole after completing the assembling of the fuse 1. Subsequently, the hole is closed.

The operation of the fuse 1 when overcurrent occurs in a power-supplying path between the battery and the inverter will now be described.

Figure 4:
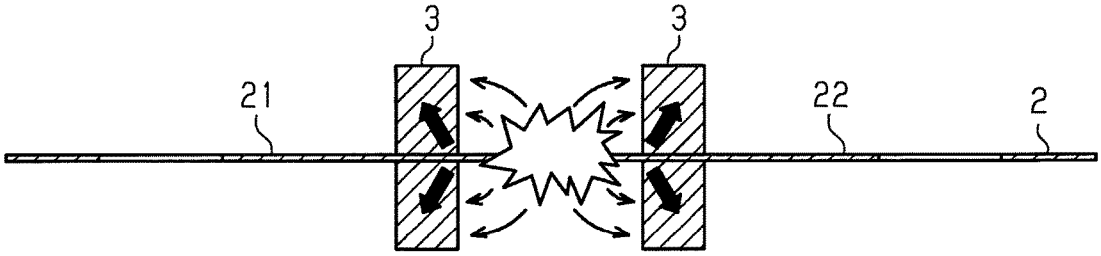
FIG. 4 is a cross-sectional view of the fuse illustrating the scattering of molten metal and the transmission of heat when an arc is generated.

When overcurrent occurs in the power-supplying path including the fuse 1, the Joule effect heats the bus bar 2 (hereinafter referred to as "Joule heat"). The amount of generated Joule heat is inversely proportional to the cross-sectional area of the bus bar 2. The element 23 has a smaller cross-sectional area than the first and second bars 21 and 22. Thus, the element 23 generates a larger amount of Joule heat than the first and second bars 21 and 22. As a result, the element 23 melts and breaks. This generates an arc between the first bar 21 and the second bar 22 that are separated into two pieces. The generation of the arc scatters molten metal (element 23). As shown by the thin arrows in FIG. 4, the two blocks 3 that hold the portion where the arc is generated in between limit the scattering of the molten metal. The molten metal remains in the case 4 and limits the collection of the molten metal on other products. Further, the generation of the arc may melt the opposing ends of the first bar 21 and the second bar 22 and such molten portions may spread. In this regard, as shown by the thick arrows in FIG. 4, the blocks 3 also function as heat accumulators for the heat transmitted by the bus bar 2. Thus, the transfer of heat to the outer side of the two blocks 3 (side opposite to portion where arc is generated) is restricted. This limits the spreading of the melting range to portions of the bus bar 2 located outside the two blocks 3. Accordingly, the melting of the bus bar 2 at the outer side of the case 4 is limited.

When the case 4 is filled with the arc extinguishing material, arcs are blocked in a preferred manner. This limits continuous generation of arcs. Further, the arcs are extinguished more quickly. This also limits the spreading of the range of the bus bar 2 that is molten by the arc heat.

As described above in detail, the first embodiment has the following advantages.

(1) The fuse 1 includes the bus bar 2 formed integrally with the element 23, the two blocks 3 coupled to the bus bar 2 to hold the element 23 in between, and the case 4 that encloses the element 23 and the two blocks 3.

In the fuse 1, the element 23 is part of the bus bar 2. Thus, the fuse 1 does not need to be welded during manufacturing like in the prior art. Accordingly, the fuse 1 can be manufactured more easily.

Further, the element 23 is arranged at a portion of the bus bar 2 between the two blocks 3. This limits the scattering of molten metal that occurs when the element 23 melts and breaks.

In addition, the case 4 encloses the element 23. This limits the collection of molten metal on other products arranged outside the case 4 when the element 23 melts and breaks. Consequently, other products are not electrically connected to each other by molten metal.

The case 4 allows the element 23 to be encapsulated in the arc extinguishing material. This blocks arcs more quickly and thus limits continuous generation of arcs.

(2) The bus bar 2 is separate from the two blocks 3. This facilitates the adjustment of the distance between the element 23 and each of the two blocks 3 and consequently facilitates the adjustment of the scattering range of molten metal when the element 23 melts and breaks.

Further, the distance between the two blocks 3 can be easily adjusted. This facilitates the adjustment of the target amount of current that melts and breaks the element 23.

Since the bus bar 2 is separate from the two blocks 3, manufacturing is facilitated even when the bus bar 2 is integrated with the two blocks 3 into a complicated shape.

(3) Each block 3 includes the through hole 31 extending through the block 3 in the axial direction and the slot 34 extending from the vertical surface 32 of the through hole 31 to the outer circumference of the block 3. The block 3 is swaged so that the two portions spaced apart from each other by the slot 34 move toward each other in a state in which the bus bar 2 inserted from the slot 34 is set in the through hole 31. This fixes the blocks 3 to the bus bar 2.

In this manner, the blocks 3 can be coupled to the bus bar 2 with the simple structure of the slot 34 and the swaging task for closing the slot 34 that is easier and more simple than welding. This facilitates the manufacturing of the fuse 1 and reduces the difference in performance between manufactured bus bars.

(4) The bus bar 2 and the blocks 3 are formed from copper, which is one type of a metal material having superior thermal conductance. This allows the heat generated by arcs when the element 23 melts and breaks to be easily transmitted from the bus bar 2 to the blocks 3. That is, the blocks 3 function as heat accumulators for the heat generated by an arc. This restricts the transfer of heat to portions of the bus bar 2 located at the outer side of the two blocks 3 and limits the melting of the bus bar 2 at the outer sides of the two blocks 3 and, consequently, the outer side of the case 4.

(5) The bus bar 2 is accommodated in the through holes 31 of the blocks 3 in a state in which contact pressure acts on the bus bar 2. This limits loosening of the bus bar 2 from the blocks 3 in the radial direction.

Second Embodiment

A second embodiment of the fuse will now be described. The fuse of the second embodiment mainly differs from the fuse of the first embodiment in that the blocks are integrated with the case. Thus, like or same reference numerals are given to those components that are the same as the corresponding components of the first embodiment. Such components will not be described in detail.

Structure

Figure 5A:
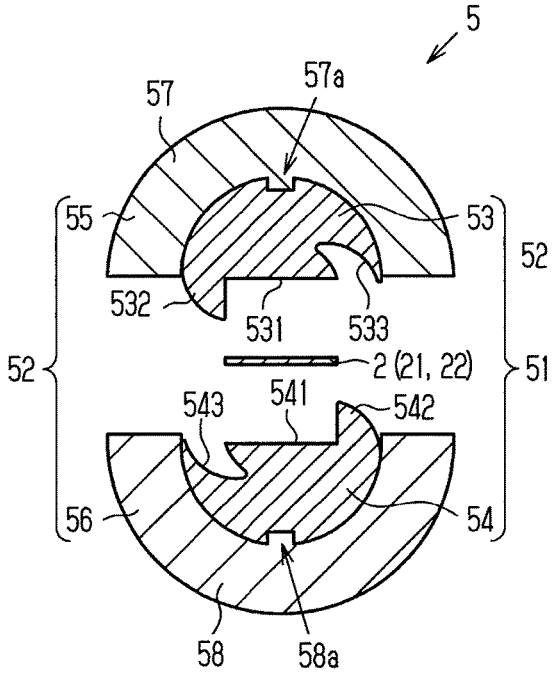
FIG. 5A is a cross-sectional view showing a fuse before a block is coupled to a bus bar in a second embodiment.
Figure 5B:
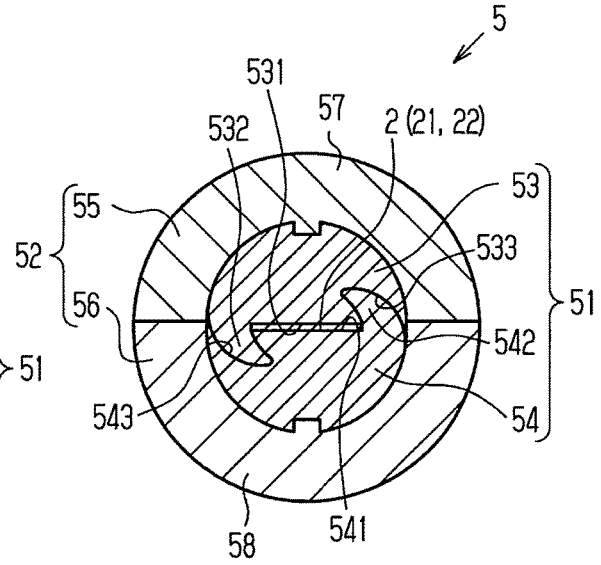
FIG. 5B is a cross-sectional view showing the fuse after the block is coupled to the bus bar.
Figure 5C:
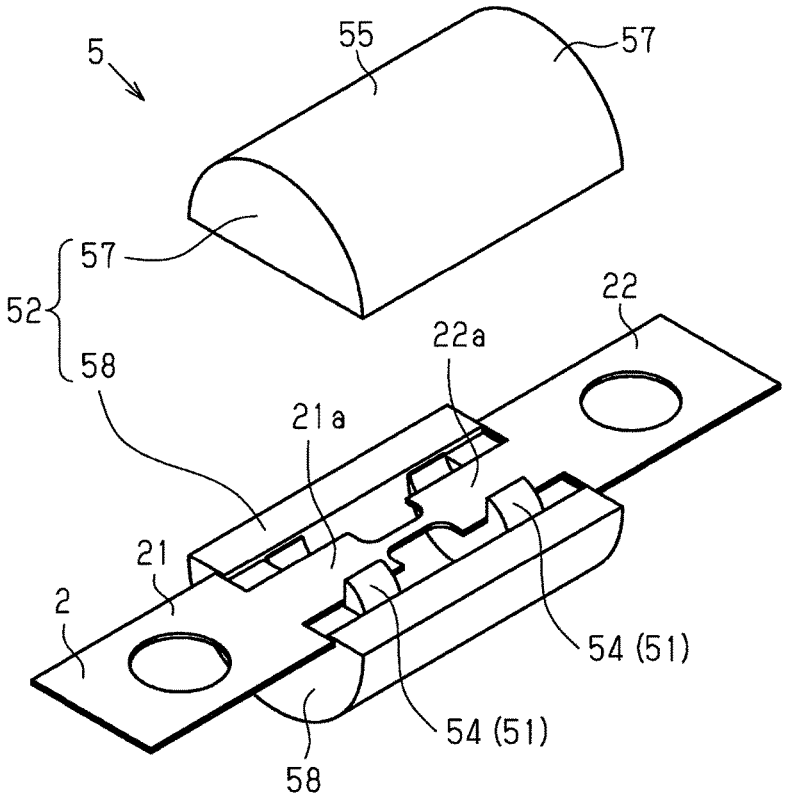
FIG. 5C is an exploded perspective view showing the fuse before the block is coupled to the bus bar.

As shown in FIG. 5C, the fuse 5 includes the bus bar 2, two blocks 51, and a case 52.

As shown in FIGS. 5A and 5B, each block 51 includes a first block member 53 and a second block member 54. The first and second block members 53 and 54 each have a semi-cylindrical shape obtained by cutting a cylinder having a diameter (outer diameter) that is greater in dimension than the plate widths of the first and second bars 21 and 22 (block coupling portions 21*a* and 22*a*) along the diameter. The block 51 is cylindrical as a whole when the first and second block members 53 and 54 are coupled to each other. The first block member 53 corresponds to a first member, and the second block member 54 corresponds to a second member.

The first block member 53 includes an opposing surface 531 that opposes the second block member 54. The opposing surface 531 includes an engagement projection 532 and an engagement recess 533. The engagement projection 532 and the engagement recess 533 are located at symmetric positions on opposites sides of the axis in an axial view of the first block member 53 (block 51). More specifically, on the opposing surface 531, the engagement projection 532 is located at the nine o'clock position (left portion) in FIG. 5, and the engagement recess 533 is located at the three o'clock position (right portion). The distance between the engagement projection 532 and the engagement recess 533 is slightly larger than the plate widths of the first and second bars 21 and 22. The engagement projection 532 is acute. The engagement projection 532 includes a curved surface that smoothly connects a distal end of the engagement projection 532 to a circumferential surface of the first block member 53 and a surface that is perpendicular to the opposing surface 531. The engagement projection 532 is shaped to have a cross section that is one quarter of a circle as a whole. The engagement recess 533 is inwardly tapered and curved in the counterclockwise direction.

The second block member 54 is shaped to be point-symmetric to the first block member 53. That is, the second block member 54 includes an opposing surface 541 that opposes the first block member 53, and the opposing surface 541 includes an engagement projection 542 opposing the engagement recess 533 and an engagement recess 543 opposing the engagement projection 532.

The case 52 includes a first semi-tubular case 55 and a second semi-tubular case 56 formed from an insulative resin material. The first and second semi-tubular cases 55 and 56 have an inner diameter that is slightly larger than the outer diameter of the blocks 51.

The first semi-tubular case 55 is integrated with two first block members 53 through a molding method such as injection molding or two-color molding. The first semi-tubular case 55 and the two first block members 53 form a first unit 57. Further, the second semi-tubular case 56 is integrated with two second block members 54 through the same molding method as described above. The second semi-tubular case 56 and the two second block members 54 form a second unit 58. A recess-projection coupling portion 57*a* is arranged between an inner surface of the first semi-tubular case 55 (surface located toward first block member 53) and an outer surface of each first block member 53 (surface located toward first semi-tubular case 55). A recess-projection coupling portion 58*a* is arranged between an inner surface of the second semi-tubular case 56 (surface located toward second block member 54) and an outer surface of the second block member 54 (surface located toward second semi-tubular case 56). The recess-projection relationship of the recess-projection coupling portions 57*a* and 58*a* restricts rotation between the first block member 53 and the first semi-tubular case 55 and rotation between the second block member 54 and the second semi-tubular case 56.

The first semi-tubular case 55 and the second semi-tubular case 56 include fasteners such as snap-fits (not shown) that engage each other in a direction in which the first semi-tubular case 55 and the second semi-tubular case 56 are coupled.

Operation

The method for assembling the fuse 5 will now be described.

In the fuse 5, the first semi-tubular case 55 and the two first block members 53 are integrated as the first unit 57, and the second semi-tubular case 56 and the two second block members 54 are integrated as the second unit 58. Thus, the fuse 5 can be assembled by moving the first unit 57 and the second unit 58 toward each other to hold the bus bar 2 (specifically, block coupling portions 21*a* and 22*a*) between the opposing surface 531 and the opposing surface 541 and clamp the bus bar 2. The fuse 5 may also be assembled by setting the second bar 22 on the second unit 58 and covering the second bar 22 with the first unit 57. The blocks 51, that is, the first and second block members 53 and 54, function as holders.

When the first unit 57 and the second unit 58 are coupled, the engagement projection 532 enters the engagement recess 543, and the engagement projection 542 enters the engagement recess 533. The engagement recesses 533 and 543 are curved in the counterclockwise direction. Thus, as the first unit 57 and the second unit 58 move toward each other, the engagement projections 532 and 542 are plastically deformed and curved in conformance with the engagement recesses 533 and 543. As shown in FIG. 5B, when the coupling of the first unit 57 and the second unit 58 is completed, the engagement projections 532 and 542 are tapered toward their distal ends and curved in the counterclockwise direction. The engagement of the engagement projection 532 and the engagement recess 543 and the engagement of the engagement projection 542 and the engagement recess 533 in a direction in which the first and second unit 57 and 58 are coupled (vertical direction in FIG. 5B) limit the separation of the first unit 57 and the second unit 58 from each other. That is, the engagement projection 532 and the engagement recess 543 correspond to fasteners, and the engagement projection 542 and the engagement recess 533 correspond to fasteners.

It is desired that fasteners arranged on the first semi-tubular case 55 and the second semi-tubular case 56 be fastened to each other just by moving the first unit 57 and the second unit 58 toward each other.

As described above in detail, the second embodiment has the advantage described below in addition to advantages (1), (2), and (4) of the first embodiment.

(6) The first semi-tubular case 55 and the two first block members 53 are integrated as the first unit 57, and the second semi-tubular case 56 and the two second block members 54 are integrated as the second unit 58. Thus, the fuse 5 can easily be assembled simply by moving the first unit 57 and the second unit 58 toward each other to hold the bus bar 2 in between. Further, the number of assembling steps is reduced.

The above embodiments may be modified as described below.

In the fuse of each of the above embodiments, the blocks hold the bus bar. Instead, the bus bar may hold the blocks.

Figure 6A:
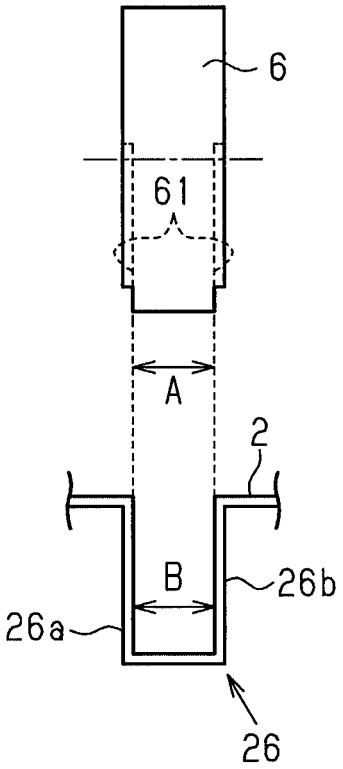
FIG. 6A is a side view showing a fuse before a block is fixed to a bus bar in another embodiment.
Figure 6B:
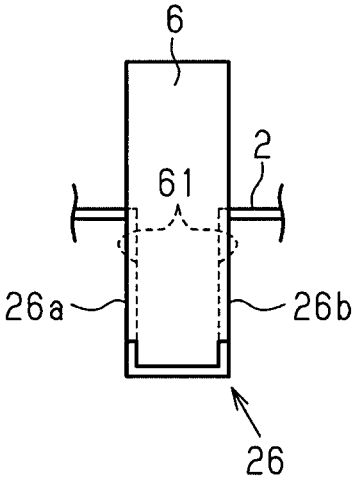
FIG. 6B is a side view showing the fuse after the block is coupled to the bus bar.
Figure 6C:
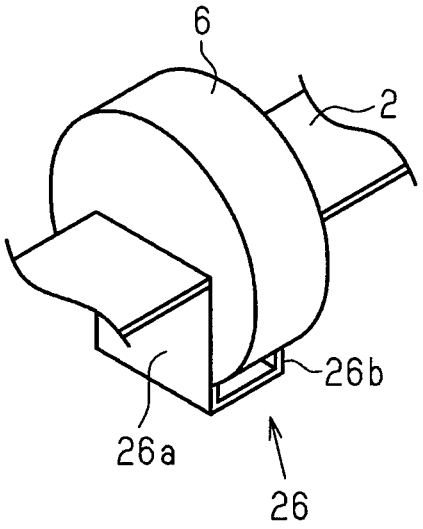
FIG. 6C is a perspective view showing the fuse after the block is coupled to the bus bar.
Figure 6D:
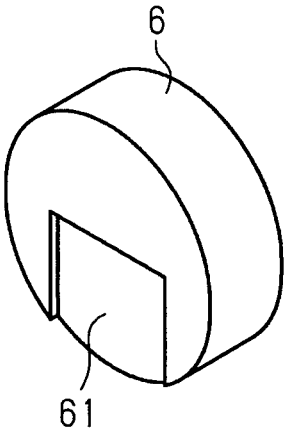
FIG. 6D is a perspective view showing the block.

For example, as shown in FIG. 6A, the bus bar 2 is bent in the thickness-wise direction to form a U-shaped holder 26. Further, as shown in FIG. 6D, a block 6 includes steps 61 that are slightly recessed from their surrounding portions to fit into the holder 26 in correspondence with the plate width and plate thickness of the bus bar 2. The distance B between opposing walls 26*a* and 26*b* of the holder 26 is slightly smaller in dimension than the axial length A of the disc-shaped block 6 (step 61) in the direction in which the bus bar 2 extends (sideward direction in FIG. 6). When the block 6 is coupled to the bus bar 2, as shown in FIGS. 6B and 6C, the block 6 (step 61) is inserted between the two walls 26*a* and 26*b* of the holder 26. Insertion of the block 6 into the holder 26 pushes the walls 26*a* and 26*b* away from each other. The block 6 is held by the resilient force acting to return the separated walls 26*a* and 26*b* back toward each other. That is, the holder 26 (walls 26*a* and 26*b*) functions as a holder. Such a structure also obtains advantage (1) of the first embodiment. Further, the steps 61 restrict rotation of the block 6 relative to the holder 26 (bus bar 2) and consequently restrict separation of the block 6 from the holder 26.

The steps 61 are not necessary. Even when the steps 61 are omitted, the block 6 is held between the two walls 26*a* and 26*b* of the holder 26.

Figure 7:
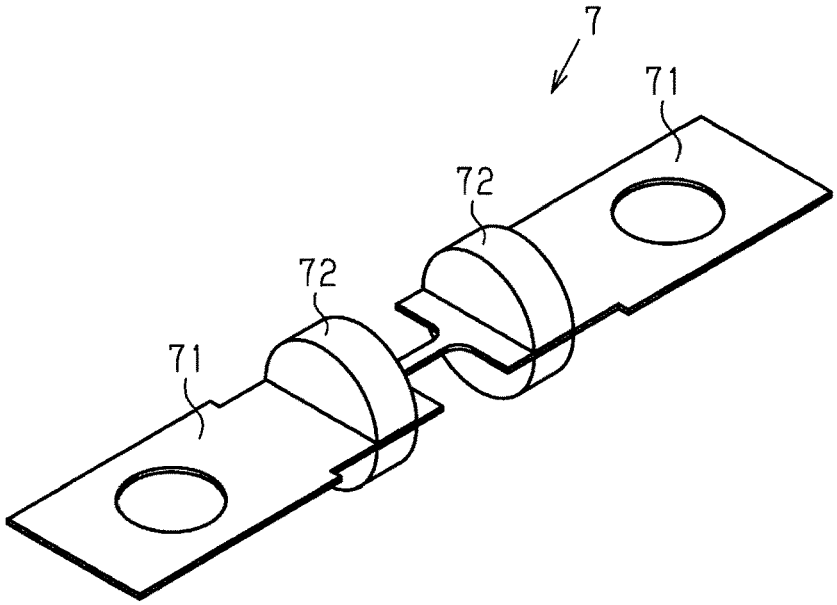
FIG. 7 is a perspective view showing a further embodiment of a bus bar.

In the fuse of each of the above embodiments, the blocks are separate from the bus bar. Instead, as shown in FIG. 7, an integrated bus bar 7 that integrates bus bars 71 with blocks 72 may be employed. In such a manner, when the bus bars and the blocks are integrated, advantage (1) of the first embodiment is obtained. Further, the fuse can be assembled simply by coupling a case to the integrated bus bar 7.

In the second embodiment, an engagement projection and an engagement recess described below may be used instead of the structures of the engagement projections 532 and 542 and the engagement recesses 533 and 543 used for the fuse 5.

Figure 8:
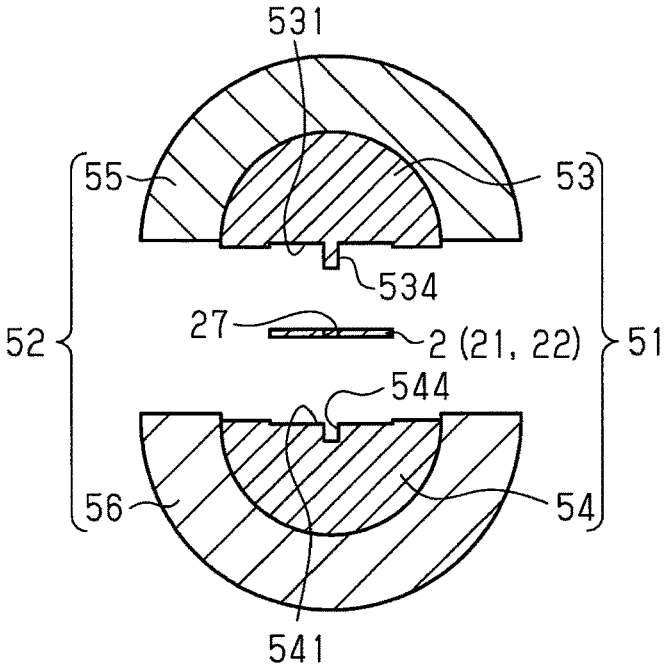
FIG. 8 is a cross-sectional view showing another embodiment of a fuse.

More specifically, as shown in FIG. 8, the first block member 53 includes an engagement projection 534, and the second block member 54 includes an engagement recess 544. The engagement projection 534 is located at a central portion of the opposing surface 531. The engagement recess 544 is located at a central portion of the opposing surface 541. The engagement projection 534 is press-fitted to the engagement recess 544. Further, the bus bar 2 (first and second bars 21 and 22) includes multiple through holes 27 (only one shown in FIG. 8). The multiple through holes 27 are located at a central portion of the bus bar 2 in the thickness-wise direction. Further, the multiple through holes 27 are arranged at fixed intervals that are longer than the axial length of the block 51 in the longitudinal direction of the bus bar 2. The engagement projection 534 can be inserted into each through hole 27. Such a structure facilitates the adjustment of the distance between the element 23 and each block 51 and the distance between the two blocks 51. It is desired that a recess be arranged around the engagement projection 534 and the engagement projection 534 in correspondence with the thickness and the plate width of the bus bar 2.

In the second embodiment, the engagement projections 532 and 542 and the engagement recesses 533 and 543 used for the fuse 5 may be omitted. In this case, the bus bar 2 is held between the first block member 53 and the second block member 54 using the fastening forces of the fasteners arranged on the first semi-tubular case 55 and the second semi-tubular case 56. Such a structure also obtains advantage (1) of the first embodiment.

In the second embodiment, the first semi-tubular case 55 and the two first block members 53 form the integrated first unit 57, and the second semi-tubular case 56 and the two first block members 54 form the integrated second unit 58. However, the first unit 57 and the second unit 58 do not have to be unitized. That is, the first semi-tubular case 55 may be separate from the two first block members 53, and the second semi-tubular case 56 may be separate from the two first block members 54.

In each of the above embodiments, the same metal material (copper) is used for the bus bar and the blocks. Instead, different metal materials may be used for the bus bar and the blocks.

It is preferred that a material having a thermal conductivity that is greater than or equal to the bus bar be used for the blocks. In such a structure, the blocks function as heat accumulators when the element melts and breaks. Further, the blocks may be formed from a non-conductive material as long as the blocks have thermal conductance.

In each of the above embodiments, the fuse is located between the battery and the inverter of the hybrid vehicle. However, the fuse does not have to be located between the battery and the inverter and may be located anywhere in an electric circuit. Alternatively, the fuse may be arranged in an electric circuit for something other than the vehicle.

In each of the above embodiments, the block has a cylindrical shape. Instead, the block may have another shape such as the shape of a tetragonal cylinder.

In each of the above embodiments, the case has a tubular shape. Instead, the case may have another shape such as the shape of a tetragonal box.

In each of the above embodiments, the case encloses the element and the two blocks. However, the case does not have to enclose the outer sides of the two blocks (sides opposite to element). That is, the case only needs to be shaped to enclose the element in cooperation with the two blocks.

In each of the above embodiments, the element 23 only needs to have a smaller cross-sectional area than other portions of the bus bar 2 so that the element 23 melts and breaks when overcurrent occurs. The shape of the element 23 is not limited to the shape shown in the drawings.

In each of the above embodiments, the block coupling portions 21*a* and 22*a* of the first and second bars 21 and 22 have a smaller plate width than other portions the first and second bars 21 and 22. However, the block coupling portions 21*a* and 22*a* may be omitted. That is, the first and second bars 21 and 22 may have the same plate width throughout except for a portion of the element 23.

DESCRIPTION OF REFERENCE CHARACTERS

1, 5: Fuse
2, 71: Bus bar
3, 6, 51, 72: Block
4, 52: Case
7: Integrated bus bar
21: First bar
22: Second bar
23: Element (melting portion)
26: Holding portion
27: Through hole
31: Through hole (holding portion)
32: Vertical surface (holding portion)
33: Horizontal surface (holding portion)

34: Slot
35: Slit
41, 42: Tubular case
53: First block member
54: Second block member
55: First semi-tubular case
56: Second semi-tubular case
57: First unit
58: Second unit
57*a*, 58*a*: Recess-projection coupling portion
61: Step
531, 541: Opposing surface
532, 534, 542: Engagement projection
533, 543, 544: Engagement recess

The invention claimed is:

1. A fuse comprising:

a conductive member formed integrally with a melting portion that melts and breaks when overcurrent occurs, and with first and second bars;

two shielding portions arranged on the conductive member to hold the melting portion in between, each of the two shielding portions being comprised of a single-piece shielding member where each shielding member is situated on the conductive member between the melting portion and the first and second bars, wherein each shielding member is disk shaped and includes a holder and a slot on one side of the holder where the slot is in communication with an outer side of the holder and extends to an outer circumference of its respective shielding member and a slit on an opposite side of the holder where the slit is in communication with an opposite outer side of the holder and extends toward but not to an opposite outer side of the outer circumference of its respective shielding member; and a case formed from an electrically-insulative material, wherein the case encloses the melting portion in cooperation with the two shielding portions.

2. The fuse according to claim 1, wherein the holder of one of the shielding members and the conductive member holds the other one of the shielding members and the conductive member.

3. The fuse according to claim 2, wherein each shielding member is coupled to the conductive member by the holder by performing swaging to close portions spaced apart by the slot in a state in which the conductive member is inserted into the holder through the slot.

* * * * *